US006886460B2

(12) United States Patent
Mayer et al.

(10) Patent No.: US 6,886,460 B2
(45) Date of Patent: May 3, 2005

(54) METHOD FOR CONDITIONING A PRINTING INK IN A PRINTING PRESS AND PRINTING PRESS FOR CARRYING OUT THE METHOD

(75) Inventors: Martin Mayer, Ladenburg (DE); Nikolaus Pfeiffer, Heidelberg (DE); Bernhard Roskosch, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/811,476

(22) Filed: Mar. 24, 2004

(65) Prior Publication Data

US 2004/0187717 A1 Sep. 30, 2004

(30) Foreign Application Priority Data

Mar. 24, 2003 (DE) ..... 103 12 996

(51) Int. Cl.[7] ..... B41F 31/06

(52) U.S. Cl. ..... 101/350.1; 101/350.3; 101/350.6; 101/367

(58) Field of Search ..... 101/350.1, 350.3, 101/350.6, 352.1, 365, 367, 363, 207, 209, 487

(56) References Cited

U.S. PATENT DOCUMENTS 4,152,986 A * 5/1979 Dadowski et al. ..... 101/463.1
4,290,362 A * 9/1981 Kobler et al. ..... 101/350.6
6,619,205 B2 * 9/2003 Maier ..... 101/350.5
6,742,452 B2 * 6/2004 Mayer et al. ..... 101/365

FOREIGN PATENT DOCUMENTS

| | | |
|---|---|---|
| CA | 2019579 | 6/1990 |
| DE | 39 33 388 A1 | 5/1990 |
| DE | 40 19 608 A1 | 1/1991 |
| DE | 41 16 988 A1 | 11/1992 |
| DE | 41 16 989 A1 | 11/1992 |
| JP | 57-135175 | 8/1982 |

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Ralph E. Locher

(57) ABSTRACT

A method for conditioning a printing ink in a printing press includes providing an ink duct roller and a metering device, operating the ink duct roller in conjunction with the metering device for liquefying the printing ink before a start of printing, and providing a further roller for removing the printing ink from the ink duct roller. Removal of the printing ink from the ink duct roller by the further roller is held in a suppressed state, while simultaneously rotating the ink duct roller at a conditioning rotational speed, and simultaneously controlling the metering device pursuant to a conditioning profile, for only partially opening the metering device at least intermittently. A printing press for performing the method is also provided.

9 Claims, 4 Drawing Sheets

METHOD FOR CONDITIONING A PRINTING INK IN A PRINTING PRESS AND PRINTING PRESS FOR CARRYING OUT THE METHOD

BACKGROUND OF THE INVENTION

Field of the Invention

The invention relates to a method for conditioning a printing ink in a printing press. The invention also relates to a printing press for performing the method.

German Published, Non-Prosecuted Patent Application DE 39 33 388 A1 discloses a conditioning method wherein printing ink is stirred in an ink duct by an ink stirring device. An unfavorable aspect of that method, among others, is that an ink stirring device of that type necessarily has to be present in order to condition the printing ink. The described ink stirring device is disposed pivotably on axle stub shafts of the ink duct roller, so that accessibility of the ink duct can be improved by pivoting the ink stirring device away from the ink duct. A prerequisite for the pivotable mounting of the ink stirring device on the axle stub shafts is a provision of a free installation space therefor, which is not available in every printing press. For that reason, the ink stirring unit is unsuitable for retrofitting to printing presses which do not have the necessary installation space. Otherwise considered, if the pivotable mounting of the ink stirring unit was dispensed with, it would no longer be possible to move the ink stirring unit away from the ink duct or fountain, so that access to the ink duct would be restricted. However, ready access to the ink duct is necessary for maintenance work to be performed on the ink duct, such as changing the printing ink received therein. A further disadvantage of the ink stirring unit also becomes apparent in conjunction with the aforementioned ink change. The ink stirring element of the latter, which dips into the printing ink, has to be cleaned in the course of every ink change, in order to thereby prevent contamination of the new printing ink introduced into the ink duct during the ink change, with adhering printing ink residues of the old printing ink removed from the ink duct during the ink change. The use of the ink stirring unit therefore entails an increased expenditure for maintenance.

The state of the prior art is further described in German Published, Non-Prosecuted Patent Application DE 40 19 608 A1, corresponding to Canadian Application 2019579 A, and in German Published, Non-Prosecuted Patent Application DE 41 16 989 A1.

SUMMARY OF THE INVENTION

It is accordingly an object of the invention to provide a method for conditioning a printing ink in a printing press and a printing press for carrying out the method, which overcome the hereinafore-mentioned disadvantages of the heretofore-known methods and devices of this general type and which permit a relatively low expenditure for equipment technology.

With the foregoing and other objects in view, there is provided, in accordance with the invention, a method for conditioning a printing ink in a printing press. The method comprises providing an ink duct roller with a metering device, and operating the ink duct roller in conjunction with the metering device for liquefying the printing ink before a start of printing. A further roller is provided for removing the printing ink from the ink duct roller, and the further roller is held in a suppressed state, while simultaneously rotating the ink duct roller at a conditioning rotational speed. The metering device is simultaneously controlled pursuant to a conditioning profile, according to which the metering device is only to be partially opened at least from time to time.

In accordance with another mode, the method of the invention further includes setting the conditioning rotational speed to at least 50% of a maximum settable rotational speed of the ink duct roller.

In accordance with a further mode, the method of the invention further includes setting the conditioning rotational speed to at least 90% of a maximum settable rotational speed of the ink duct roller.

In accordance with an added mode, the method of the invention further includes forming, pursuant to the conditioning profile, a conditioning metering gap width of the metering device, which has a first value greater than zero and less than 50% of the maximum settable metering gap width of the metering device, and thereafter has a second value which is at least approximately zero.

In accordance with an additional mode, the method of the invention further includes forming the conditioning metering gap width with the first value and the second value alternatingly a plurality of times during the conditioning of the printing ink.

In accordance with yet another mode of the method of the invention, the conditioning profile is dynamic.

In accordance with yet a further mode of the method of the invention, the conditioning profile is linear.

In accordance with yet a further mode of the method of the invention, the printing ink is thixotropic.

With the objects of the invention in view, there is also provided a printing press comprising an electronic control device, and an inking unit including an ink duct roller, a metering device associated with the ink duct roller, and a further roller. The control device is programmable for activating the inking unit appropriately when performing a method for conditioning a printing ink in the printing press in a program-controlled manner. The method includes operating the ink duct roller in conjunction with the metering device for liquefying the printing ink before a start of printing, removing the printing ink from the ink duct roller by holding the further roller in a suppressed state, while simultaneously rotating the ink duct roller at a conditioning rotational speed, and simultaneously controlling the metering device pursuant to a conditioning profile, according to which the metering device is to be partially opened at least from time to time.

An advantage of the method according to the invention in terms of cost is that it is possible therewith to dispense with any requirement for a special ink stirring unit. The printing press with which the method according to the invention is performed therefore does not require an ink stirring unit of that type at all. Instead, in the method for conditioning the printing ink according to the invention, only devices already present in the printing press are used, namely the metering device, the ink duct roller and the further roller which, for example, can be a vibrating roller. Those devices which are already present in any case, however, serve for a heretofore unknown purpose in accordance with the present invention and are controlled for this purpose in a completely atypical manner.

The conditioning performed in accordance with the invention has the effect of subjecting the printing ink to a liquid shear loading which generally causes the viscosity of the printing ink to be reduced during the conditioning. The conditioning occurs before the printing ink runs out of the ink duct and into the main part of the inking unit, i.e., chronologically before the ink entry into the inking unit roller train, which is necessary for inking the entire inking unit, and hence also before the start of production printing.

While the conditioning method is being performed, the supply of printing ink situated in the ink duct is kept at least approximately constant. At most, the volume of printing ink present in the ink duct can fluctuate negligibly or inconsequently, for example, if the conveyed or circulated volume of printing ink, which is conveyed by the ink duct roller out of the ink duct from the bottom during the conditioning and subsequently conveyed back into the ink duct at the top, changes on the ink duct roller. In order to keep the supply of printing ink present in the ink duct constant, the further roller is kept in a deactivated state during the conditioning, so that the further roller cannot pick up the printing ink from the ink duct roller. If the further roller is a vibrating roller, it is possible to shut down the vibrating movement of the vibrating roller for the duration of the conditioning. The vibrating movement is performed during the printing operation reciprocatingly between the ink duct roller and the roller train. In any case, the further roller is prevented from picking up the printing ink from the ink duct roller, which is disposed upstream of the further roller, and/or transferring the printing ink to the roller train of the inking unit which is disposed downstream of the further roller.

The conditioning rotational speed, at which the ink duct roller rotates during the conditioning, can be kept constant throughout the entire conditioning period. The conditioning rotational speed may, however, also be varied during the conditioning. For example, the conditioning rotational speed can rise as the conditioning period elapses or as the conditioning duration increases.

It is a property of the conditioning profile, on one hand, that a metering gap of the metering device is either continuously open from the beginning to the end of the conditioning, or that it is only open for a proportionate part of the total conditioning time. This feature relating to the opening time applies equally to all inking zones of the metering device. On the other hand, it is also a property of the conditioning profile that, although the metering gap is open during the conditioning, it is never completely open and not open as far as it possibly could be in construction terms. This feature relating to the opening width also applies equally to all inking zones of the metering device.

The method according to the invention also has further advantages with respect to the aforementioned state of the art wherein the ink stirring unit is used:

It is advantageous with regard to the maintenance of the ink duct that access to the ink duct is completely unimpeded at all times by providing the possibility of omitting the ink stirring unit. Due to the fact that it is possible to omit the ink stirring unit in the method according to the invention, it is now also only necessary to clean the ink duct, and no longer the ink stirring element of the ink stirring unit, in the event of an ink change. The ink change is therefore concluded more rapidly. Moreover, the method according to the invention is extremely well suited to the retrofitting of printing presses. In the context of retrofitting of this type, it is unnecessary to perform any changes in the printing press which relate to the "hardware", i.e, the mechanical parts of the printing press, but rather only changes which relate to the "software". The method according to the invention can be implemented in the printing press to be retrofitted in that an electronic control device of the printing press is reprogrammed. In the simplest case, a mobile data carrier of the printing press, for example a floppy disk, is replaced by a new data carrier whereon there is a program update which contains the program sequence of the method according to the invention.

In a refinement of the method according to the invention, which is advantageous with regard to performing the conditioning rapidly, the conditioning rotational speed is at least 50% and preferably even at least 90% of the maximum settable rotational speed of the ink duct roller. Generally, there is an upper limit to the rotational speed of the ink duct roller due to design or structural conditions, such as the power capacity of the motor which drives the ink duct roller. The conditioning rotational speed is selected to be as high as possible under consideration of the design or structural conditions and overload protection. In other words, the conditioning rotational speed should be selected to be as little as possible below the upper rotational speed limit. The higher the conditioning rotational speed, the faster the conditioning is concluded.

In a refinement of the method according to the invention, which is advantageous with regard to intensive rheological loading of the printing ink and therefore effective liquefaction, according to the conditioning profile, a conditioning metering gap width of the metering device assumes a first value, which is greater than 0% and less than 50% of the maximum settable metering gap width of the metering device, and thereafter a second value, which is at least approximately zero. According to the conditioning profile, the conditioning metering gap width or conditioning opening width of the metering device within each inking zone of the metering device is, at least for a period of time, between 0% and 50% of the maximum opening width or maximum settable metering gap width of the metering device. The printing ink is squeezed intensively when it is conveyed through the metering gap which has been set simultaneously in all inking zones in a manner corresponding to that for the first value. Although the metering gap is open to allow the printing ink to pass therethrough, it is also very narrow when the metering gap is set in a manner corresponding to the first value. Due to this narrowness, which would not exist if the metering gap were open by more than 50% of the maximum metering gap width or even completely open (100%), the printing ink is thus squeezed and squashed in an intensive manner between the metering device and the ink duct roller. The maximum metering gap width is dictated by design or structural conditions of the metering device, such as the limited nature of the possible adjusting travel of the metering elements of the metering device when it has been displaced away from the ink duct roller. After the metering device has been maintained in a manner adjusted to the first value in a first phase of the conditioning, the metering gap is at least approximately closed completely in a subsequent second phase, i.e., in the second phase, the rotating ink duct roller can convey as little as no printing ink out of the ink duct through the metering gap. In the second phase, it is not possible for the ink duct roller to convey printing ink through the metering gap and out of the ink duct within any inking zone. During the second phase, the metering element (e.g. metering doctor blade) or the metering elements (e.g. metering eccentrics) of the metering device is/are set as closely as possible against the ink duct roller within all the inking zones, directly or indirectly through a so-called ink duct foil. The film of printing ink which is formed on the ink duct roller in the first phase is, in principle, completely doctored off again in the second phase by the metering device. This doctoring process causes an intensified exchange of the printing ink situated on the ink duct roller with the remaining printing ink situated in the ink duct.

In a refinement of the method according to the invention, which is likewise advantageous with regard to particularly effective liquefaction of the printing ink, the conditioning metering gap width assumes the first value and the second value alternately a number of times during the conditioning of the printing ink. As a result thereof, the aforementioned first phase of building up a film on the ink duct roller and the likewise aforementioned second phase of doctoring off the printing ink from the ink duct roller alternate with one another a number of times. Provision is therefore made for a number of preferably periodically recurring open/closed cycles of the metering gap. The metering device is initially only partially open and then completely closed in every one of these open/closed cycles.

It is believed to be evident from the explanation of the aforementioned refinement that the conditioning profile is accordingly not an immovable, static one, and it therefore does not retain one and the same opening width permanently during the conditioning period. On the contrary, the conditioning profile is a movable, dynamic multiple-position profile wherein, during the conditioning period, the opening width of the metering gap is changed at least once in at least most of the provided inking zones, and preferably at least once in every inking zone that is provided.

In a mode of the method according to the invention, which has likewise proved to be very advantageous functionally in tests, the conditioning profile is linear. Accordingly, during the conditioning, the metering device can be open to the same extent in the first phase and simultaneously closed in the second phase in all of the inking zones thereof. Therefore, the respective opening width and metering gap width can have at least approximately one and the same dimension in every inking zone during the conditioning. It is possible for that dimension to be varied from instant to instant of time within the conditioning period. This can be ensured, for example, by synchronous control of the metering device. Through the use of this synchronous control, it is possible to achieve the situation wherein all of the metering elements of the metering device are kept set in each case synchronously with one another to one and the same setting line, both when the first value is set and also when the second value is set, and preferably also during the adjustment from one value to the other value.

The printing ink, which is thixotropic and has been conditioned in a manner according to the invention, is preferably a lithographic printing ink, for example an offset printing ink, or a letterpress printing ink. The printing ink is pasty or, when compared with other printing inks, highly viscous. The viscosity of the printing ink prior to the conditioning is even greater than after the conditioning.

Also included within the scope of the invention but going beyond the method according to the invention per se is a printing press having an electronic control device and an inking unit which includes an ink duct roller, a metering device that is associated with the ink duct roller, and a further roller, in particular a vibrating roller. The printing press is distinguished by the control device being programmed in such a way that it correspondingly activates the inking unit when performing the method according to the invention or one of the refinements or modes thereof in a program-controlled manner.

It is possible for a program to be stored in the control device, e.g. on a floppy disk or on a hard disk. The program steps of the program serve to control the execution of the method according to the invention.

Other features which are considered as characteristic for the invention are set forth in the appended claims.

Although the invention is illustrated and described herein as embodied in a method for conditioning a printing ink in a printing press and a printing press for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
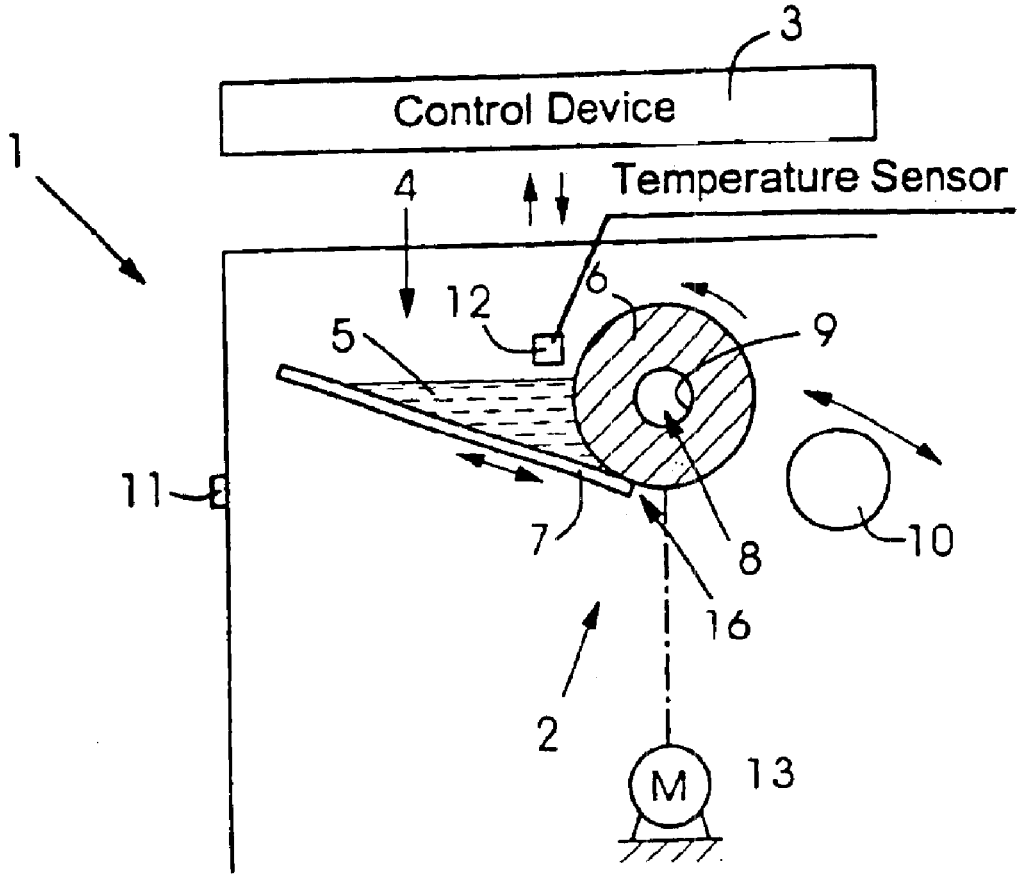
FIG. 1 is a diagrammatic, side-elevational view, partly in section, of a printing press, along with a block diagram of a temperature sensor and a control device.

Referring now to the figures of the drawings in detail and first, particularly, to FIG. 1 thereof, there is seen a portion of a printing press 1, which includes an inking unit 2 and an electronic control device 3 for the printing press 1, wherein a program is stored for controlling the method according to the invention. The inking unit 2 has a wedge-shaped ink duct or fountain 4 with a printing ink 5 received therein, and an ink duct roller 6 associated with the ink duct 4. The printing ink 5 is a typical offset ink and therefore has thixotropic properties.

The ink duct or fountain 4 includes a metering device 7 for zonal ink metering of the printing ink 5. The ink duct roller 6 is incorporated into a temperature-control medium circuit 8, which has temperature-control medium (water) flowing through a temperature-control medium channel 9 disposed in the interior of the ink duct roller 6 and, accordingly, controls the temperature of the circumferential surface of the ink duct roller 6 to a required extent. A vibrating roller 10, which periodically comes into rolling contact with the ink duct roller 6 during printing operation, is also a constituent part of the inking unit 2. The latter also includes further rollers, such as distributor rollers, applicator rollers and transfer rollers which, however, are not shown in the drawings in the interest of simplicity.

Moreover, there is further provided a switch 11 which is disposed on a wall of the printing press 1 and serves for activating the program stored in the control device 3. Instead of being disposed as illustrated, the switch 11 could be situated on a central operating desk of the printing press 1, for example in the form of a so-called touchscreen button. The ink duct 2 has a temperature sensor 12 associated therewith which serves for measuring the actual temperature of the printing ink 5 in the ink duct 2 or, instead thereof, the ink temperature on the circumferential surface of the ink duct roller 6.

The ink duct roller 6 is rotated by an electric motor 13 having a power consumption which is measured by the control device 3. The connection of the motor 13 to the ink duct roller 6 is represented diagrammatically in FIG. 1 by a phantom or dot-dash line.

In FIG. 1, moreover, the rotational movement of the ink duct roller 6, the reciprocating movement of the vibrating roller 10 and the movement of the metering device 7 are symbolized by appropriate movement arrows.

Figure 2:
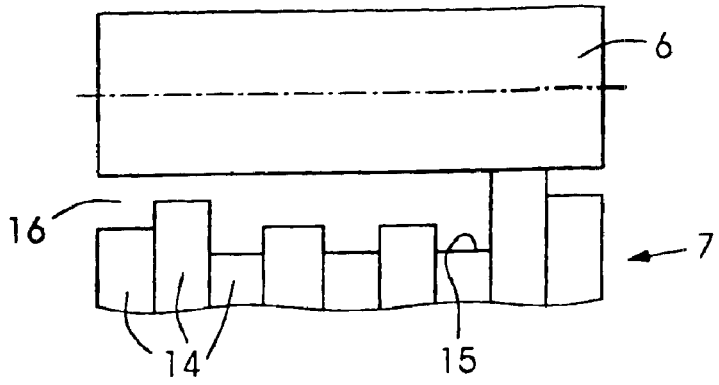
FIGS. 2 to 5 are fragmentary, front-elevational views of a metering device of the printing press, showing the metering device in various settings thereof in accordance with the method of the invention.

In FIG. 2, the metering device 7 is shown from another perspective, from which it is possible to discern individual inking zones 14 into which the metering device 7 is subdivided. These inking zones 14 can be determined by metering eccentrics, metering slides, metering tongues or by bending points of a metering doctor blade or by other metering elements likewise disposed in a row parallel to the ink duct roller 6, and are settable or adjustable in a manner corresponding to that of an inking profile 15 which is required for production printing and for the printing image used in this regard. A metering gap 16, which is formed between the metering device 7 and the ink duct roller 6 and through which the printing ink 5 is conveyed out of the ink duct 4 by the ink duct roller 6, is open to a greater or lesser extent in each inking zone 14 in a manner corresponding to that of the ink requirement specific to the printing image in the inking zone.

Figure 3:
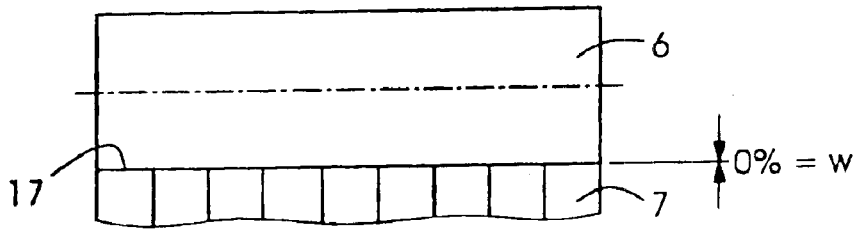

FIG. 3 shows one of two extreme settings of the metering device 7. In this setting, the metering device 7 is completely closed in all of the inking zones 14. Therefore, every one of the metering elements of the metering device 7 rests on the ink duct roller 6 over the entire width of the respective inking zone, if necessary or desirable, over an ink duct foil disposed between the metering element and the ink duct roller 6.

Figure 4:
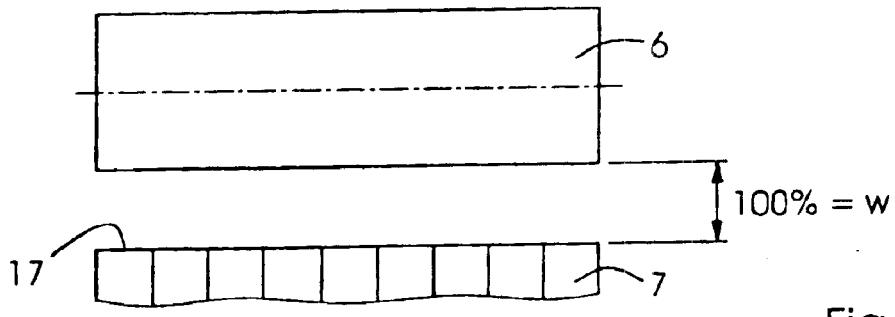

FIG. 4 shows the other of the two extreme settings of the metering device 7. In this setting, the metering device 7 is open as far as construction permits in the region of every inking zone 14.

Figure 5:
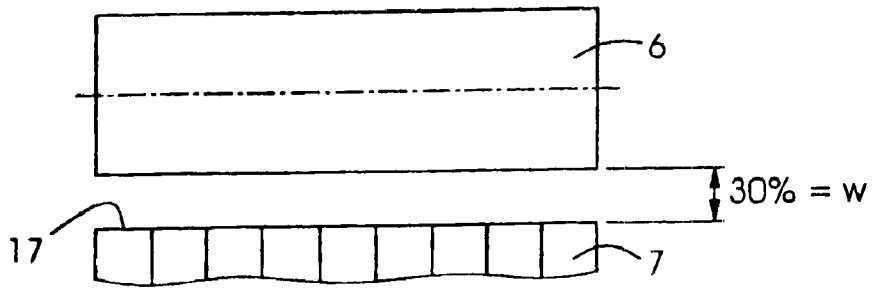

FIG. 5 shows a setting ("medium" or "mean" opening width) lying between the two extreme settings (note FIGS. 3 and 4), with respect to an opening width w of the metering gap 16. In the setting according to FIG. 5, the opening width w is approximately 30% of the maximum opening width w according to FIG. 4.

In order to gain a better understanding of the method according to the invention described above, the background thereof should initially be explained.

The viscosity of the printing ink 5 depends upon whether, among other conditions, this printing ink 5 has only just been introduced into the ink duct 4 during the setting up of the printing press 1 (so-called ink fresh from the can) or this printing ink 5 has already been tumbled about or rolled around for a period of time while in the ink duct 4 by the rotation of the ink duct roller 6. For example, it may have tumbled or rolled on a previous day or during the current work shift (so-called previous day's ink, and accordingly subjected to liquid shearing. In other words, it has been discovered that the history of the printing ink 5 to be printed plays a role which is not inconsiderate for achieving a stable production printing state (without using the method according to the invention). The more fluid the condition of the printing ink 5, the greater the optical ink density which is measurable in the printed image on the printing material sheet. For this reason, it is particularly important for production printing to reach the stable viscosity level of the printing ink 5 as quickly as possible and to maintain it thereafter. The period of time for reaching the stable viscosity level, at which the viscosity virtually changes no longer, is proportional to a number z of printing material sheets which are printed in this time period.

Figure 6:
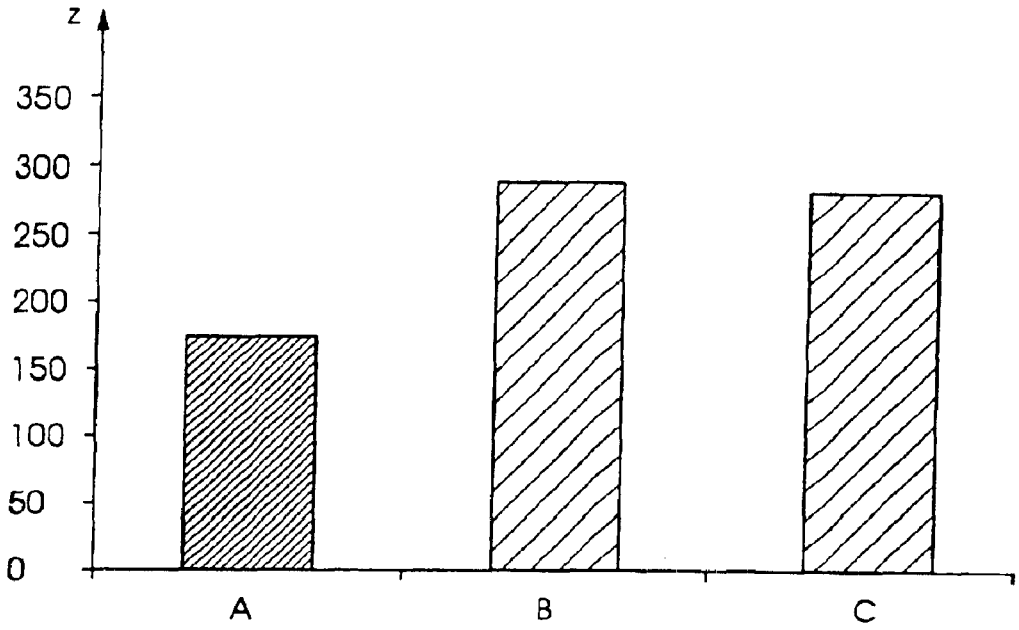
FIGS. 6 to 9 are various graphs or plot diagrams showing the advantageous effect of the method according to the invention and comparisons of the method according to the invention with methods deviating therefrom.

FIG. 6 is a plot diagram or graph, having an ordinate representing this number z of sheets. This graph shows three bars for printing tests A, B and C which deviate from one another with regard to the test conditions or parameters. In the printing test B, the method according to the invention was not used and the previous day's ink was used as printing ink 5. In printing test C, the method according to the invention was likewise not used and the ink fresh from the can was used.

In contrast with the fact that the method according to the invention was not used in the printing tests B and C, the method according to the invention was used in the printing test A. It is unimportant for the depicted result of the printing test A whether the ink fresh from the can or from the previous day was used therein, since the result was the same in both cases. The printing ink 5 used in printing test A is referred to below as "conditioned ink". It is believed to be readily apparent from the graph of FIG. 6 that the printing press 1 according to printing test A using the method according to the invention needs a much shorter time period or a number of sheets z proportional to the time period than without using the method according to the invention. In the printing test A, z=176 printing material sheets, in the printing test B, z=291 printing material sheets, and in the printing test C, z=287 printing material sheets were needed or printed before the stable viscosity level was reached.

The heretofore unmentioned remaining test conditions, such as the machine speed and the ink temperature, were clearly identical with one another in all of the test series or printing tests A, B and C.

Figure 7:
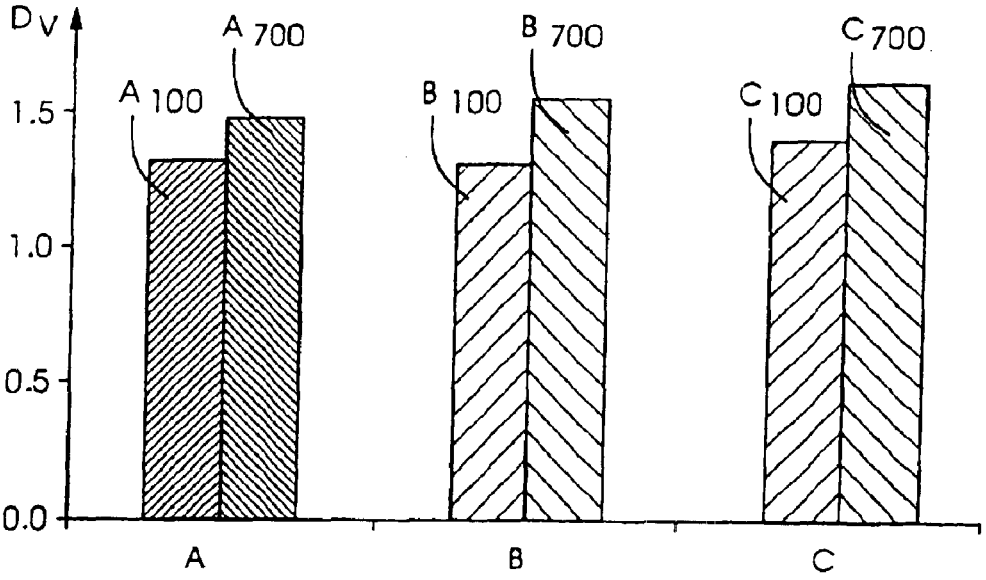

FIG. 7 is a graph with an ordinate displaying the optical ink density (full tone density) in the printed image. This graph also relates to the aforementioned printing tests A, B and C. Each of the printing tests A, B and C are respectively represented by a pair of bars. The ink density measured values identified with indices 100 were determined by using the $100^{th}$ printing material sheet (z=100) of the respective printing test A, B or C. In contrast, the other ink density measured values $A_{700}$, $B_{700}$ and $C_{700}$ were measured at the respective sheet count z=700.

It is believed to be apparent from FIG. 7 that the optical ink density (and therefore the viscosity of the printing ink 5) changes to a far lesser extent from the $100^{th}$ to the $700^{th}$ printing material sheet in printing test A than in printing tests B and C. The individual measured values are as follows:

$A_{100}$: $D_V$=1.32
$A_{700}$: $D_V$=1.47
$B_{100}$: $D_V$=1.30
$B_{700}$: $D_V$=1.54
$C_{100}$: $D_V$=1.39
$C_{700}$: $D_V$=1.60

Figure 8:
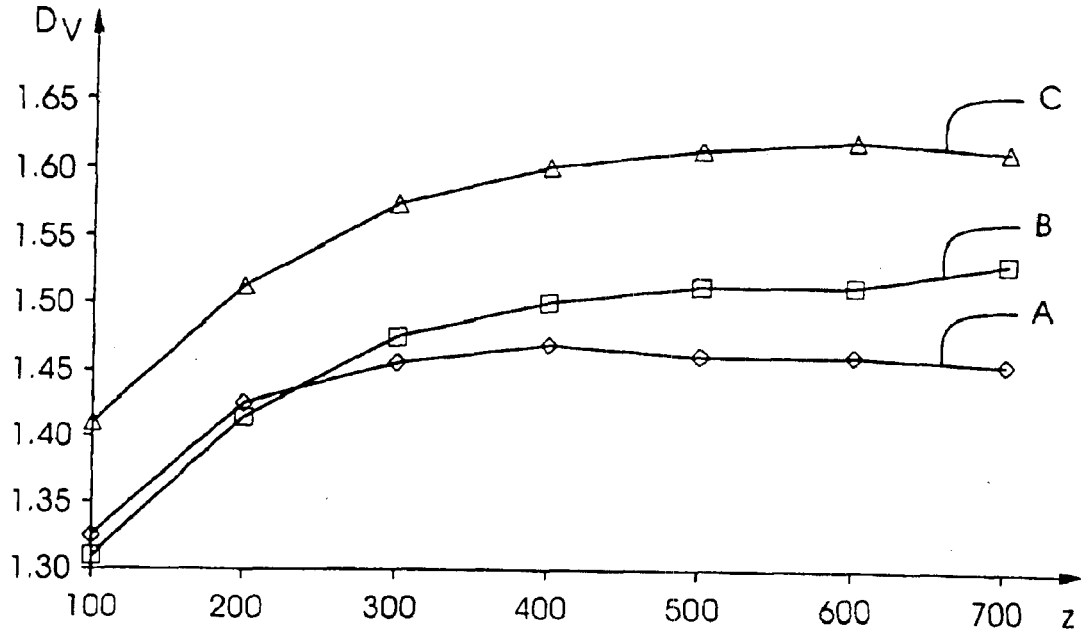

The graph shown in FIG. 8 is the most meaningful with regard to the advantages achieved by the invention. It has an ordinate which displays the optical ink density $D_V$ and an abscissa which displays the number of sheets z, and represents, as it were, a summary of the other two graphs (see FIGS. 6, 7). The printing tests A, B and C are represented by curves in the graph, and a comparison of them shows that using the ink conditioned in a manner according to the invention (printing test A) achieves the stationary continuous printing or final ink density, which corresponds to the stable viscosity level and only varies within a narrow tolerance range of ±4%, approximately 65% more quickly than using unconditioned ink (printing tests B and C).

The ink conditioning method according to the invention functions as follows:

Directly after the printing ink 5 is transferred from the ink can thereof into the ink duct 4 or, after a relatively long interruption of printing operation, during which the printing ink has been resting in the ink duct 4 and has, therefore, not been exposed to an ample amount of shear in the metering gap 16, the operator starts the sequence of the program by actuating the switch 11, by which the individual method steps of the ink conditioning are automatically carried out.

Figure 9:
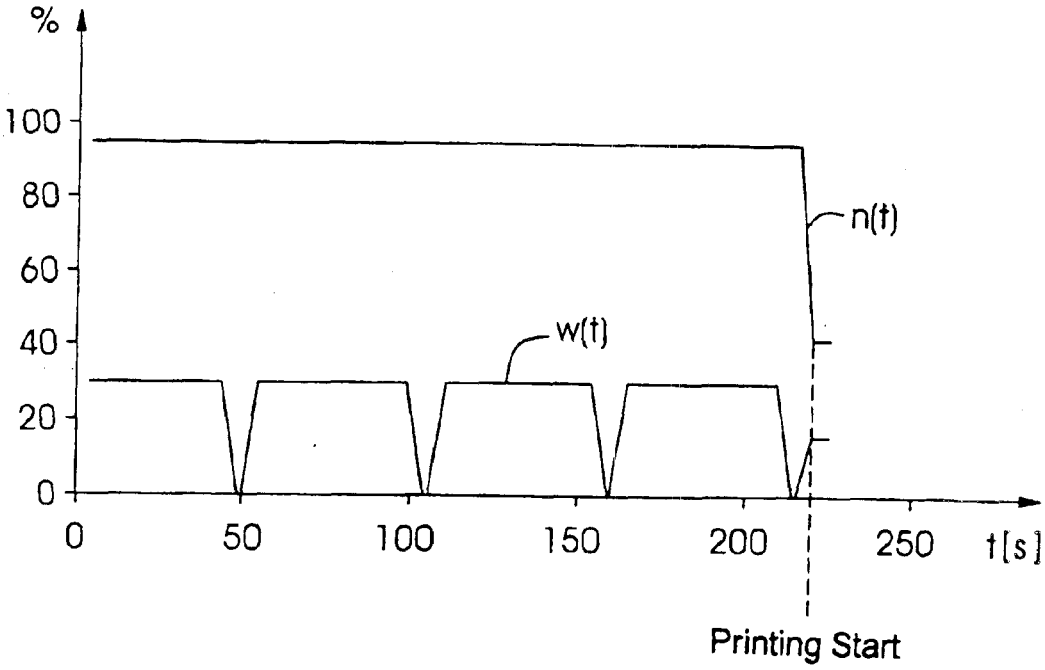

In accordance with the program, the rotational speed n of the ink duct roller 6 is set to a maximum or to the at least approximately maximum rotational speed value which can be set on the printing press 1, whereby the control device 3 activates the motor 13 in an appropriate manner. This method step is illustrated in the graph of FIG. 9, wherein the upper curve shows the rotational speed n of the ink duct roller 6 as a function of time (the abscissa represents time t in seconds). According to this graph in FIG. 9, the rotational speed n is 95% of the maximum rotational speed which can be set.

Simultaneously with this method step, or shortly before or shortly thereafter, a further method step is carried out wherein a so-called conditioning profile 17 is set on the metering device 7, which deviates from the non-illustrated input profile necessary for the so-called ink input, and from the inking profile 15 which is necessary for production printing (note FIG. 2). In contrast with the inking profile 15, the conditioning profile 17 is not dependent upon the printing image, on the one hand, and is dynamic, on the other hand.

While the inking profile 15, besides possible required readjustments and corrections, respectively, is in principle maintained unchanged after it has been set for the respective print job while the printing press 1 is being set up, the conditioning profile 17 changes a number of times during the conditioning of the printing ink 5 from the condition shown in FIG. 5 to the condition shown in FIG. 3, and back again.

The setting of the conditioning profile 17 which is effected by appropriate activation of the metering device 7 by the control device 3 takes place in detail as follows: Initially, all of the metering elements of the metering device 7 are set to a spaced distance relative to the ink duct roller 6 so that the "medium" opening width is produced in every inking zone 14. The lower curve of the graph shown in FIG. 9 represents the opening width w which is equally large for all inking zones 14 during every instant in the conditioning phase. Moreover, it is believed to be apparent from the graph in FIG. 9 that the "medium" opening width is 30% of the maximum opening width which can be set (note FIG. 4). When the "medium" opening width has been set, all the metering elements lie on a straight line and at the same setting level or height, respectively. The "medium" opening width is selected so that as large a volumetric proportion as possible of the printing ink 5 is subjected to shear between the metering device 7 and the ink duct roller 6 and thus liquefied (conditioned) per unit time, the printing ink 5 to be subjected to shear being conveyed out of the ink duct 4 on the ink duct roller 6 during the revolution of the ink duct roller 6 and being conveyed back into the ink duct 4 again after being subjected to shear. Thereby, stirring of the supply of printing ink in the ink duct 4 takes place.

After a number of revolutions of the ink duct roller 6, which have been prescribed and executed in accordance with the program, all the inking zones 14 are closed in a further method step, i.e., the conditioning profile 17 is set to the second condition thereof (note FIG. 3). Thereafter, all of the inking zones 14 are kept closed by the control device 3 at least for the duration of one complete revolution of the ink duct roller 6, so that no printing ink 5 at all is conveyed out of the ink duct 4 during the duration. Due to this measure of maintaining the inking zones closed, the printing ink 5 to be conditioned is squeezed or doctored off and stripped, respectively, from the ink duct roller 6 by the metering device 7 and, as a result, the exchange of the printing ink 5 during the conditioning thereof is intensified, and the thorough mixing of previously heavily liquefied volumetric proportions of the printing ink 5 with volumetric proportions which have not been so heavily liquefied is intensified.

The hereinafore-described method steps can be executed one after the other a number of times during the conditioning, so that the inking zones 14 are opened and closed cyclically and periodically.

In FIG. 9, there are shown several, namely four, periodically open/closed cycles of the conditioning phase, i.e., consecutive changes of the conditioning profile 17 from the closed condition thereof (note FIG. 3) to the open medium width condition thereof (note FIG. 5), in accordance with the w (p) curve. The aforementioned conditioning phase can last approximately 3 to 8 minutes and is automatically interrupted by the control device 3 when the operator signals the control device 3 to commence a printing operation by pressing a button or the like. A consequence of this signal is that the control device 3 sets the rotational speed necessary for production printing by appropriately activating the ink duct roller 6 in a final method step, and the inking profile 15 necessary for production printing is set and the reciprocatory movement (vibrating movement) of the vibrating roller 10 and, accordingly, ink removal from the ink duct roller 6 by the vibrating roller 10 are started. The vibrating roller 10 was at a standstill during the preceding conditioning phase, so that the vibrating roller 10 did not remove any printing ink 5 from the ink duct roller 6 during the conditioning.

The following modifications of the method according to the invention are practicable.

Various conditioning parameters, such as the duration of the whole conditioning phase and the number of open/closed cycles, respectively, could be selected automatically by the control device 3 as a function of the respective then, i.e. directly preceding, downtime of the printing press 1.

A further modification calls for additionally assisting the stirring and mixing, respectively, performed by the ink duct roller 6 and the subjecting of the printing ink 5 to shear performed by the interaction of the ink duct roller 6 and the metering device 7, i.e., reducing the viscosity of the printing ink 5 mechanically by exploiting the thixotropy thereof, by a thermally effected viscosity reduction. For this purpose, the actual value of the temperature of the circumferential surface of the ink duct roller 6, during the conditioning phase, is regulated and maintained, respectively, in an equalized or balanced state, in a manner corresponding to a specific roller-temperature nominal or desired value, by the tempering-medium circuit and channel 8, 9, or the actual value of the ink temperature of the printing ink 5 situated in the ink duct 6 is regulated or maintained in an equalized or balanced condition in a manner corresponding to a specific nominal or desired value of the printing ink temperature. The nominal or desired value to be maintained in the respective case can be, for example, 30° C. The control device 3 regulates (two point regulation) the tempering or temperature-control medium circuit 8 so that the respective actual value is kept at least approximately constant and is approximately 30° C. in the example given.

Finally, another modification should be mentioned, according to which the conditioning phase is automatically interrupted by the control device 3 precisely at the instant when the latter determines by measurement of the power consumption of the motor 13 that the printing ink 5 has been liquefied to an extent which is sufficient in the interim. The power consumption of the motor 13 is proportional to the viscosity of the printing ink 5. If the latter is yet comparatively viscid, the motor 13 needs more energy in order to rotate the ink duct roller 6 against the Theological resistance of the printing ink 5. If, in contrast, the printing ink 5 is already comparatively quite fluid, the motor 13 needs less energy to rotate the ink duct roller 6 and to overcome the rheological resistance of the printing ink 5. This relationship is utilized in conditioning control that is dependent upon the power consumption of the motor.

We claim:

1. A method for conditioning a printing ink in a printing press, which comprises:

providing an ink duct roller (6) and a metering device (7);

operating the ink duct roller (6) in conjunction with the metering device (7) for liquefying the printing ink (5) before a start of printing;

providing a further roller (10) for removing the printing ink (5) from the ink duct roller (6); and holding removal of the printing ink (5) from the ink duct roller (6) by the further roller (10) in a suppressed state, while simultaneously rotating the ink duct roller (6) at a conditioning rotational speed, and simultaneously controlling the metering device (7) pursuant to a conditioning profile, for only partially opening the metering device at least from time to time.

2. The method according to claim 1, which further comprises setting the conditioning rotational speed to at least 50% of a maximum settable rotational speed of the ink duct roller.

3. The method according to claim 1, which further comprises setting the conditioning rotational speed to at least 90% of a maximum settable rotational speed of the ink duct roller.

4. The method according to claim 1, which further comprises forming, pursuant to the conditioning profile, a conditioning metering gap width of the metering device, having a first value greater than zero and less than 50% of a maximum settable metering gap width of the metering device, and thereafter having a second value being at least approximately zero.

5. The method according to claim 4, which further comprises forming the conditioning metering gap width alternatingly with the first value and the second value a plurality of times during the conditioning of the printing ink.

6. The method according to claim 1, wherein the conditioning profile is dynamic.

7. The method according to claim 1, wherein the conditioning profile is linear.

8. The method according to claim 1, wherein the printing ink is thixotropic.

9. A printing press, comprising:

an electronic control device (3); and an inking unit (2) including:

an ink duct roller (6);

a metering device (7) associated with said ink duct roller (6); and a further roller (10);

said control device (3) being programmed for activating said inking unit appropriately when performing a method for conditioning a printing ink in the printing press in a program-controlled manner, which includes:

operating said ink duct roller in conjunction with said metering device for liquefying the printing ink before a start of printing; and holding removal of the printing ink from said ink duct roller by said further roller in a suppressed state, while simultaneously rotating said ink duct roller at a conditioning rotational speed, and simultaneously controlling said metering device pursuant to a conditioning profile, for only partially opening said metering device at least from time to time.

* * * * *